US007911073B2

(12) United States Patent
Smith

(10) Patent No.: US 7,911,073 B2
(45) Date of Patent: Mar. 22, 2011

(54) SYSTEM AND METHOD FOR A HYDRO-HYDRAULIC GRAVITATIONAL GENERATOR

(76) Inventor: Todd Smith, Bellevue, WA (US)

( * ) Notice: Subject to any disclaimer, the term of this patent is extended or adjusted under 35 U.S.C. 154(b) by 349 days.

(21) Appl. No.: 12/247,901

(22) Filed: Oct. 8, 2008

(65) Prior Publication Data

US 2010/0084866 A1 Apr. 8, 2010

(51) Int. Cl.
*F03B 13/12* (2006.01)

(52) U.S. Cl. ..... 290/53; 290/42; 290/43; 290/54; 417/330; 417/331; 60/398; 60/641.7

(58) Field of Classification Search ..... 290/42, 290/43, 53, 54; 60/398, 698, 641.7, 325, 60/327, 646, 659, 657, 512, 415, 39.57, 39.01, 60/39.182; 417/330–333; 415/3.1; 416/85; 405/76

See application file for complete search history.

(56) References Cited

U.S. PATENT DOCUMENTS

| | | | | |
|---|---|---|---|---|
| 3,028,727 | A | 4/1962 | Anston | |
| 3,447,474 | A | 6/1969 | Lellos | |
| 4,091,618 | A * | 5/1978 | Jackson | 60/497 |
| 4,218,192 | A * | 8/1980 | West | 417/333 |
| 4,307,299 | A | 12/1981 | Norton | |
| 4,335,319 | A | 6/1982 | Mettersheimer, Jr. | |
| 4,490,232 | A * | 12/1984 | Lapeyre | 204/278 |
| 4,691,115 | A | 9/1987 | Robinson | |
| 4,698,969 | A | 10/1987 | Raichlen et al. | |
| 4,754,157 | A | 6/1988 | Windle | |
| 5,017,087 | A | 5/1991 | Sneddon | |
| 5,186,822 | A | 2/1993 | Tzong et al. | |
| 6,445,078 | B1 | 9/2002 | Cieslak | |
| 6,644,937 | B2 | 11/2003 | Han | |
| 6,729,857 | B2 | 5/2004 | Zabtcioglu | |
| 6,768,216 | B1 | 7/2004 | Carroll et al. | |
| 6,800,954 | B1 * | 10/2004 | Meano | 290/53 |
| 6,812,588 | B1 | 11/2004 | Zadig | |
| 6,930,406 | B2 | 8/2005 | Montgomery | |
| 7,402,028 | B2 * | 7/2008 | Wong | 417/328 |
| 7,795,748 | B2 * | 9/2010 | DeAngeles | 290/43 |
| 2005/0023836 | A1 | 2/2005 | Abdalla | |
| 2005/0193729 | A1 | 9/2005 | Vichakyothin et al. | |

FOREIGN PATENT DOCUMENTS

| | | |
|---|---|---|
| WO | 9737123 | 10/1997 |

* cited by examiner

*Primary Examiner* — Tho D Ta

(74) *Attorney, Agent, or Firm* — Kevin D. Jablonski; Graybeal Jackson LLP

(57) ABSTRACT

A system and method for generating electricity using a hydro-hydraulic gravitational generator. In such a system, a main housing that is disposed in deep water may be exposed to deep water pressure. A piston disposed in the main housing may be raised as water enters the main housing. Water passing through water turbines generate electricity in this phase. After the piston is raised to its highest point within the main housing, the main housing may be exposed to atmospheric pressure such that the gravitational force on the piston expels the water that was just drawn in. The expelling water also may generate electricity by being passed though water turbines. The cycle may be repeated and electricity may be continuously generated.

20 Claims, 9 Drawing Sheets

SYSTEM AND METHOD FOR A HYDRO-HYDRAULIC GRAVITATIONAL GENERATOR

BACKGROUND

The generation of electrical energy is an ever-increasing need in today's world. The best sources for the generation of electrical energy typically come from capturing and converting energy from naturally occurring resources, such as hydro and solar power. In specific, the flow of water past a turbine, such as in a hydro-electric dam can provide electrical power that is from a renewable source, leaves no carbon footprint, and is potentially limitless.

However, in many instances constructing additional dams to store the water necessary to power such hydroelectric generators is not practical due to the nature of the water source. By example, for many rivers, the grade of the available terrain may be too shallow for a dam of sufficient height to develop the required water flow for the efficient operation of a hydroelectric turbine. In other drawbacks, many communities that need electric power may be too far away from a suitable river. Further yet, the ecological impact or economic expense of constructing such a dam may be prohibitive.

Other technologies have been explored, such as capturing and converting energy from tidal flow and wave motion. However, these technologies are subject to tidal and wave conditions that may not be reliable. These technologies, while seemingly promising, have yet to develop reliable means of delivering meaningful electrical energy.

In exploring new sources for generating electrical energy, one may look to sources of naturally occurring energy phenomenon that remain constant and limitless. Two examples of constant and limitless energy are gravity due to the mass of the earth and deep water pressure due to the mass of the oceans.

What is needed is a system and method that consistently provides stable electrical energy in quantities suitable for addition to the electrical power grid by taking advantage of hydroelectric power generation technology. Furthermore, such a system and method should not rely on variable conditions (e.g., tides, river level, terrain, etc.) for efficient operation of a hydroelectric generator. Moreover, such a system and method should be as efficient as possible in converting energy from water flow into electricity.

BRIEF DESCRIPTION OF THE DRAWINGS

Aspects and many attendant advantages of the subject matter disclosed herein will become more readily appreciated as the same become better understood by reference to the following detailed description, when taken in conjunction with the accompanying drawings, wherein.

DETAILED DESCRIPTION

The following discussion is presented to enable a person skilled in the art to make and use the subject matter disclosed herein. The general principles described herein may be applied to embodiments and applications other than those detailed above without departing from the spirit and scope of the subject matter disclosed herein. This disclosure is not intended to be limited to the embodiments shown, but is to be accorded the widest scope consistent with the principles and features disclosed or suggested herein.

Figure 1:
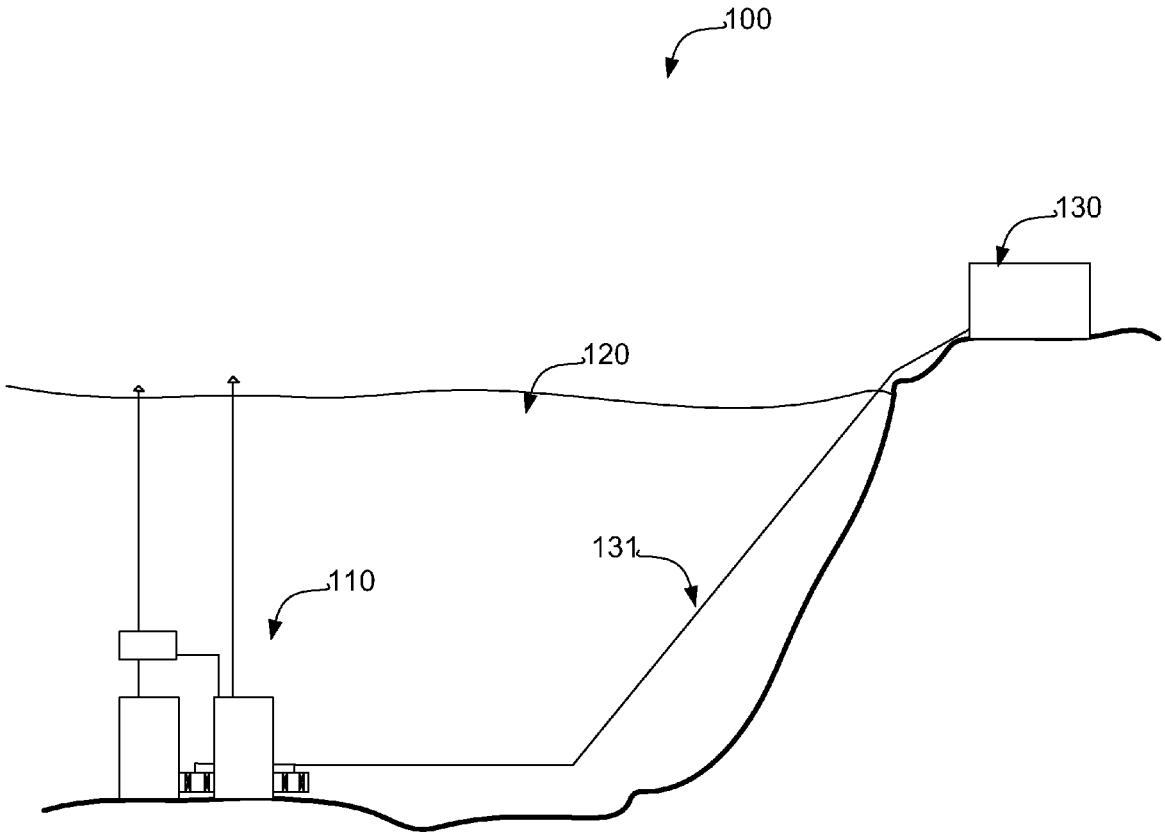
FIG. 1 shows a system for generating electrical energy using a hydro-hydraulic gravitational generator according to an embodiment of the subject matter disclosed herein.

FIG. 1 shows a system for generating electrical energy using a hydro-hydraulic gravitational generator according to an embodiment of the subject matter disclosed herein. In this system 100, a hydro-hydraulic gravitational generator (HHG generator) 110 is positioned in deep water 120 to take advantage of constant forces of gravity and water pressure to generate electricity. Deep water 120, such as near the floor of any ocean, large inland sea, deep lake, or man-made structure constantly exerts 62.42796 pounds of pressure per cubic foot. A column of water 1 square foot at a depth of 100 feet exerts a pressure at its base of 6,242 pounds of pressure (3 tons). The same column of water at 500 feet would exert nearly 16 tons of pressure at its base. As the cross sectional area expands from 1 foot to larger dimensions, the area of pressure exertion increases with the surface area of the column of water.

As will be detailed further below, an HHG generator 110 positioned in deep water 120 may be electrically coupled, via an underwater transmission line 131 to a typical electric utility distribution system 130 that is positioned on land near the location of the HHG generator 110. Such a distribution system 130 is then coupled to a local electric grid (not shown). The system 100 is then operable to generate electricity on the electric grid.

This electrical power generating process described herein has a very low environmentally impact, is renewable, limitless, and economical. While other emerging energy technologies use natural resources, such as corn for ethanol or wind for windmills, the HHG generator system 100 is not dependant on weather conditions, tidal flow, time of day, or rainfall. Deep water environmental conditions are located in a constant environment and are independent of weather conditions, time of day or year. The generation of this electricity is described in more detail below with respect to FIGS. 2-8.

Figure 2:
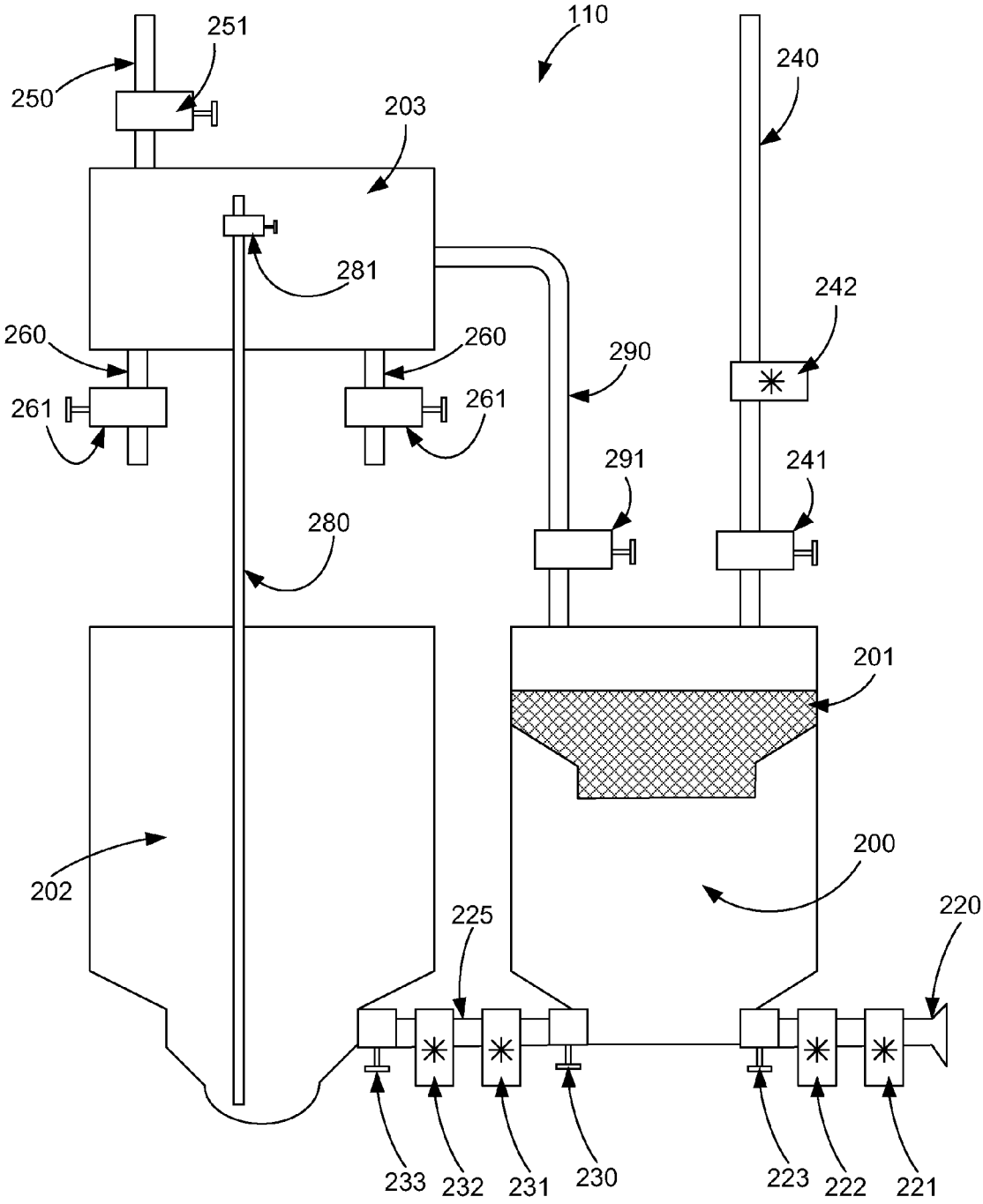
FIG. 2 shows a diagram of a hydro-hydraulic gravitational generator according to an embodiment of the subject matter disclosed herein.

FIG. 2 shows a diagram of a hydro-hydraulic gravitational generator 110 according to an embodiment of the subject matter disclosed herein. The HHG generator 110 includes a main housing 200 that has an internal piston 201. The piston 201 is free to move up and down inside the main housing 200. The piston weight and size may be determined by the size of the overall system and the depth to which it is placed. The piston may weigh less than the weight or force of the external water pressure (i.e., external water pressure may exert a force greater than that of gravity working on the piston). For example, if the external water pressure exerts a 6 ton pressure, then the internal piston 201 should weigh less than 6 tons so that the water pressure will be greater than the weight of the internal piston 201 and will move the internal piston 201 upward. The internal piston 201 should also, however, weigh more than the weight of the column of water in a water exit line 225. As gravity acts on the internal piston 201 pulling it down, its gravitational force is greater than the water weight expelling it from the water exit line 225. Without the weight of the internal piston 201, the water in the main housing 200 would be at equilibrium and would not move. With the weight of the internal piston 201 applying a force on the water in the main housing 200, gravity acting on the internal piston 201 pulls it down expelling the water from the main housing 200. FIG. 2 shows the piston 201 at a mid-level position in the main housing 200. Water may be introduced into the main housing 200 through and intake line 220 and may exit the main housing through an exit line 225. Water entering and exiting the main housing 200 will cause the piston 201 to rise up and lower down depending on the water level in the main housing 200 under the piston 200.

As water enters and exits the main housing 200, it passes though water turbines that generate electricity when water is passed through them. For example, when no water is inside the main housing 200, a water intake valve 223 may be opened. The surrounding water, exerting a pressure of 5 tons psi, is then allowed to enter the main housing 200. The surrounding water, at 5 tons psi is a greater force than the weight of the piston at 3 tons, so the water is forced into the main housing 200 through the intake line 220 and causes the piston 201 to rise (from water pressure force). The incoming water is passed through a first and second water turbine 221 and 222 suitable for generating electricity as it passes through the intake line 220. Although only two turbines are shown here, it is well understood that any number of turbines may be present in the intake line 230.

Similarly, if the main housing 200 is full of water and an exit line valve 230 is opened while the intake valve 223 is closed, water then flows out of the main housing 200 through the water exit line 225, and into a water collection housing 202. The water is forced out of the main housing 200 because of the gravitational force of the piston 201. The water exit line 225 also typically includes first and second water turbines 231 and 232 for generating electricity as water is passed through. Additionally, a collection housing valve 233 allows or prevents the flow of water in and out of the collection housing 202.

Additionally, the main housing 200 includes an atmospheric pressure line 240 with an atmospheric pressure line valve 241. The atmospheric pressure line 240 may also include one or more air turbines 242 for generating electricity. The interaction and operation of these valves, turbines and housings is illustrated and discussed in more detail below with respect to FIGS. 4-8.

The HHG generator 110 may further include a vacuum draw housing 203 for assisting with filling and draining water from the collection housing 202 and assist with air pressure at the main housing 200. The vacuum housing 203 is coupled to the main housing 200 via a vacuum draw control line 290 which includes a vacuum draw control line valve 291. Further, the vacuum housing 203 is coupled to the collection housing 202 via a water siphon line 280 that includes a water siphon line valve 281. Further yet, the vacuum draw housing 203 includes a vacuum atmospheric pressure line 250 with a vacuum atmospheric pressure line valve 251 as well as one or more water release lines 260 having respective water release valves. Again, the interaction and operation of these valves, lines and housings is illustrated and discussed in more detail below with respect to FIGS. 4-8.

FIGS. 1 and 2 provide an overview of a basic system 100 for generating electrical power using a HHG generator 110. Those skilled in the art will understand that the actual specifications and dimensions of the various components described above may vary with respect to the size (volume of water flow and time desired for that water flow), shape (tall and narrow housings or short and wide housings), the water depth the HHG generator 110 is placed in relation to the weight of the piston 201, (e.g., the water pressure in the HHG generator 110 needs to be greater than the weight of the piston 201, therefore a lighter piston allows for a more shallow depth).

Figure 3:
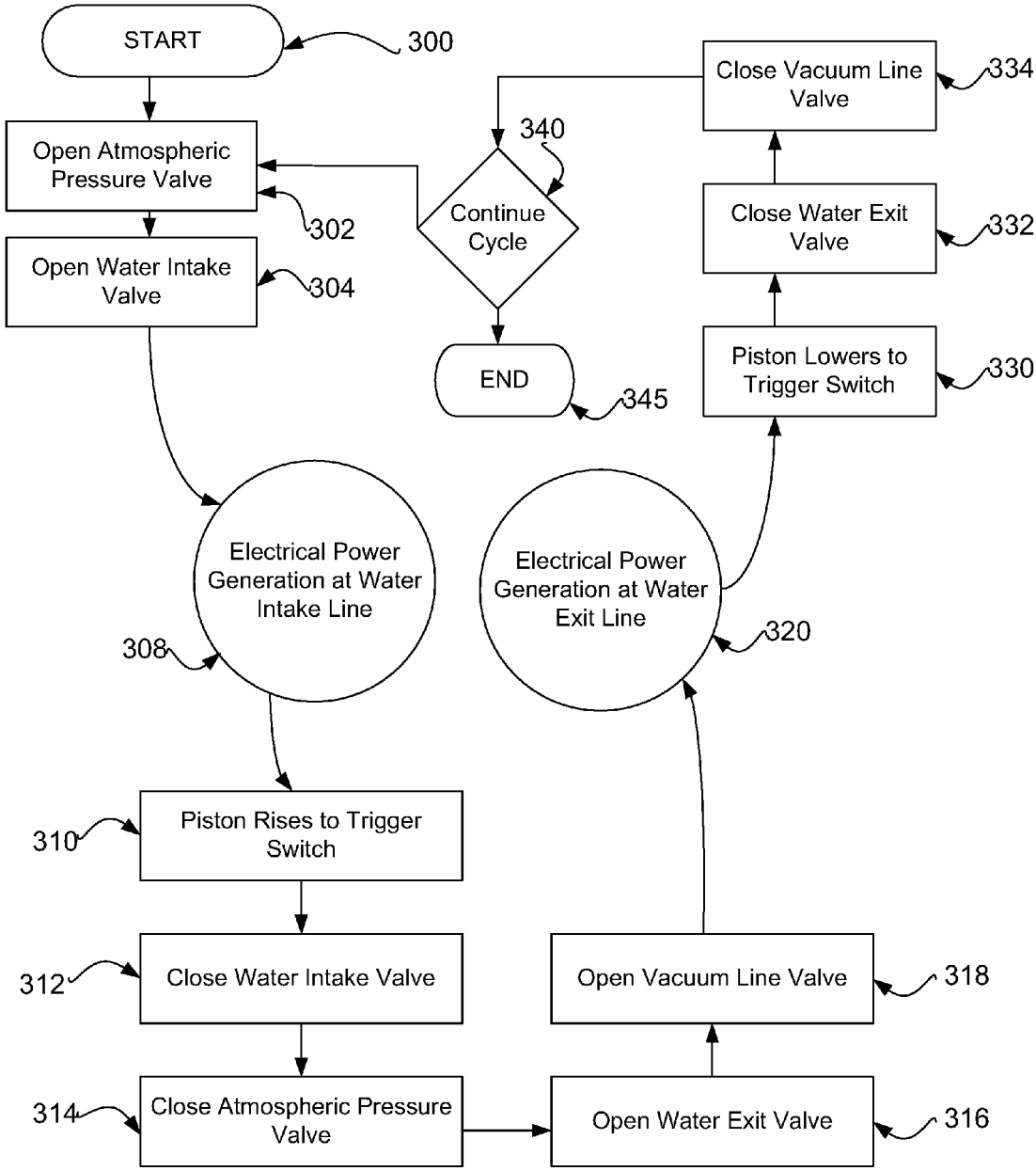
FIG. 3 shows a diagram of a method for generating electrical energy using the system of FIG. 2 according to an embodiment of the subject matter disclosed herein.

FIG. 3 shows a diagram of a method for generating electrical energy using the system of FIG. 2 according to an embodiment of the subject matter disclosed herein. The following discussion of FIG. 3 is presented with respect to steps of such a method and any references numerals to specific devices and aspects of FIG. 2 are not included in the discussion of FIG. 3.

The method starts at step 300 and then moves to an initialization phase at step 302. The atmospheric pressure valve is opened at step 302 and this will allow air that is in the main housing above the piston to escape to the atmosphere as the piston rises. Next, at step 304, the water intake valve is opened and this will allow water to enter into the main housing. As water begins to fill the main housing through the water intake line, electrical power is generated by the water passing through the water intake line and through any water turbines that are disposed within the water intake line at step 308. Of course, as water begins to fill the main housing, the piston begins to rise as a result of the water pressure buildup below it and any air within the main housing is expelled out the atmosphere pressure line.

Electrical power generation continues until the piston reaches a high enough level to trigger a switch at step 310 which, in turn, causes the water intake valve to close at step 312. Additionally, the atmospheric pressure valve is closed at step 314. The main housing is then in a momentary state of equilibrium as the water pressure below the piston is substantially equivalent to the gravitational force pulling down the piston. At this point, if air pressure were to be introduced into the main housing, the gravitational force on the piston will overcome the water pressure force from below.

Thus, at step 316 a water exit valve opens and at step 318 a vacuum line valve opens. The opening of these valves provides a path for expelled water to flow from the main housing to the water collection housing through a water exit line and also provides a path for air to be drawn into the main housing as the piston begins to descend. As water expelled from the main housing passes through the water exit line, one or more water turbines may generate electrical power at step 320.

The electrical power generation at step 320 continues until the piston is lowered to a trigger point at step 330. Once the piston is lowered to the trigger point, the water exit valve is closed at step 332 as well as the vacuum line valve at step 334. At this point, the main housing is back to a beginning state and the water collection housing now contains the expelled water from the main housing. At step 340, the cycle may then continue and revert back to step 302 or may be ended at step 345. These steps of such a method as well as additional aspects of the various methods discussed herein are better understood with reference to the specific diagrams in FIGS. 4-8 as discussed below.

Figure 4:
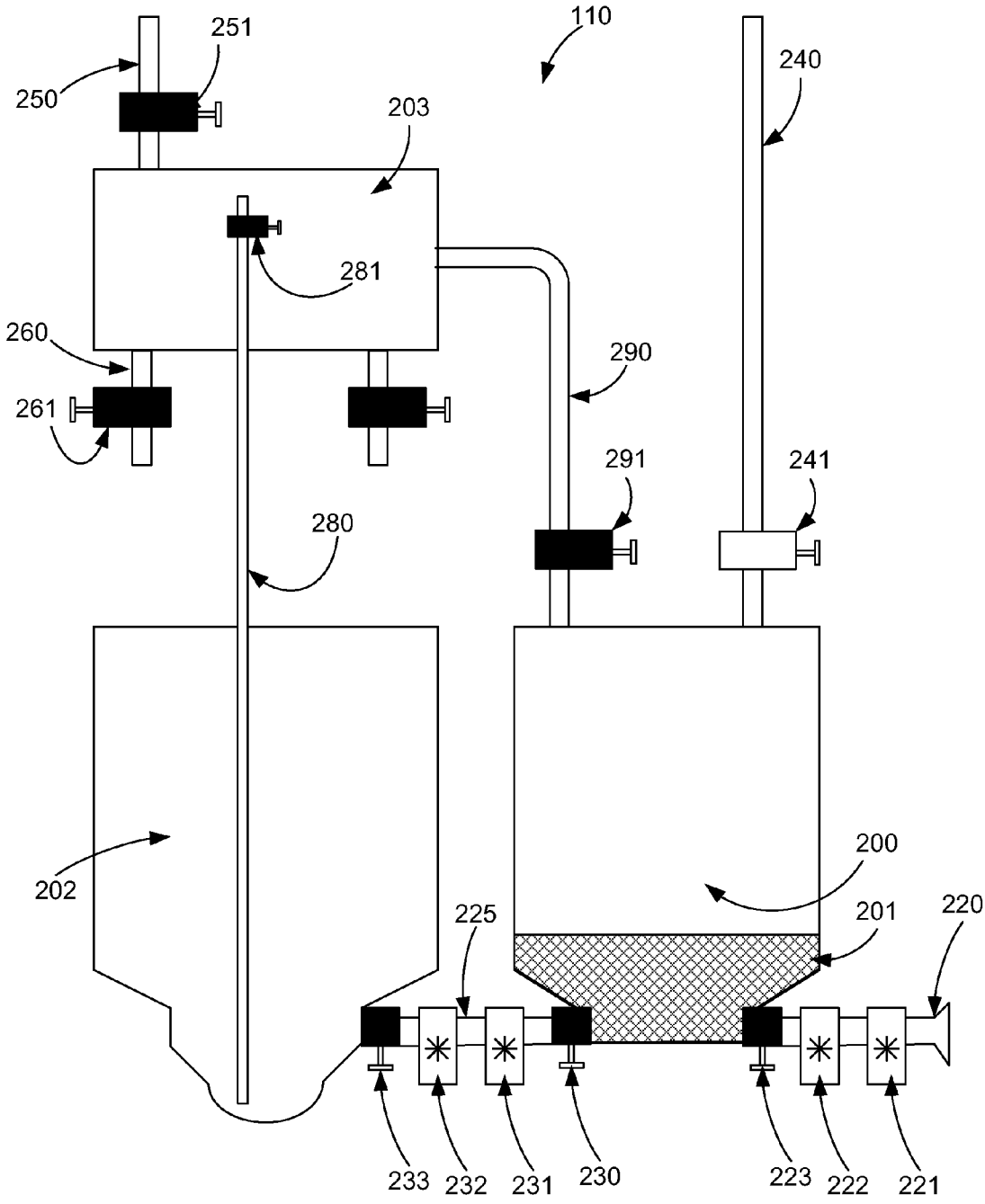
FIG. 4 shows a diagram of a hydro-hydraulic gravitational generator during an initialized state ready to begin a cycle for electrical power generation according to an embodiment of the subject matter disclosed herein.

FIG. 4 shows a diagram of a hydro-hydraulic gravitational generator during an initialized state ready to begin a cycle for electrical power generation according to an embodiment of the subject matter disclosed herein. In this state, the main housing 200 does not have any water inside and, because of this, the piston 201 is at its lowest position in the main housing 200. Further, in the main housing 200 above the piston 201, the air inside is exposed to normal surface atmospheric pressure via the atmospheric pressure line 240 as the atmospheric pressure line valve 241 is open. The atmospheric pressure line 240 is an air vent that extends all the way to the surface of the deep water so that a normal level of surface atmospheric pressure exists in the main housing 200 above the piston 201. As the piston 201 rises, air inside the main housing 200 may be expelled out the atmospheric pressure line 240.

In this beginning state, all other valves are closed including the water intake valve 223. The cycle described above with respect to FIG. 3 may begin when the water intake valve 223 is opened and deep water pressure is applied to the base of the piston 201 causing it to begin rising within the main housing 200.

Figure 5:
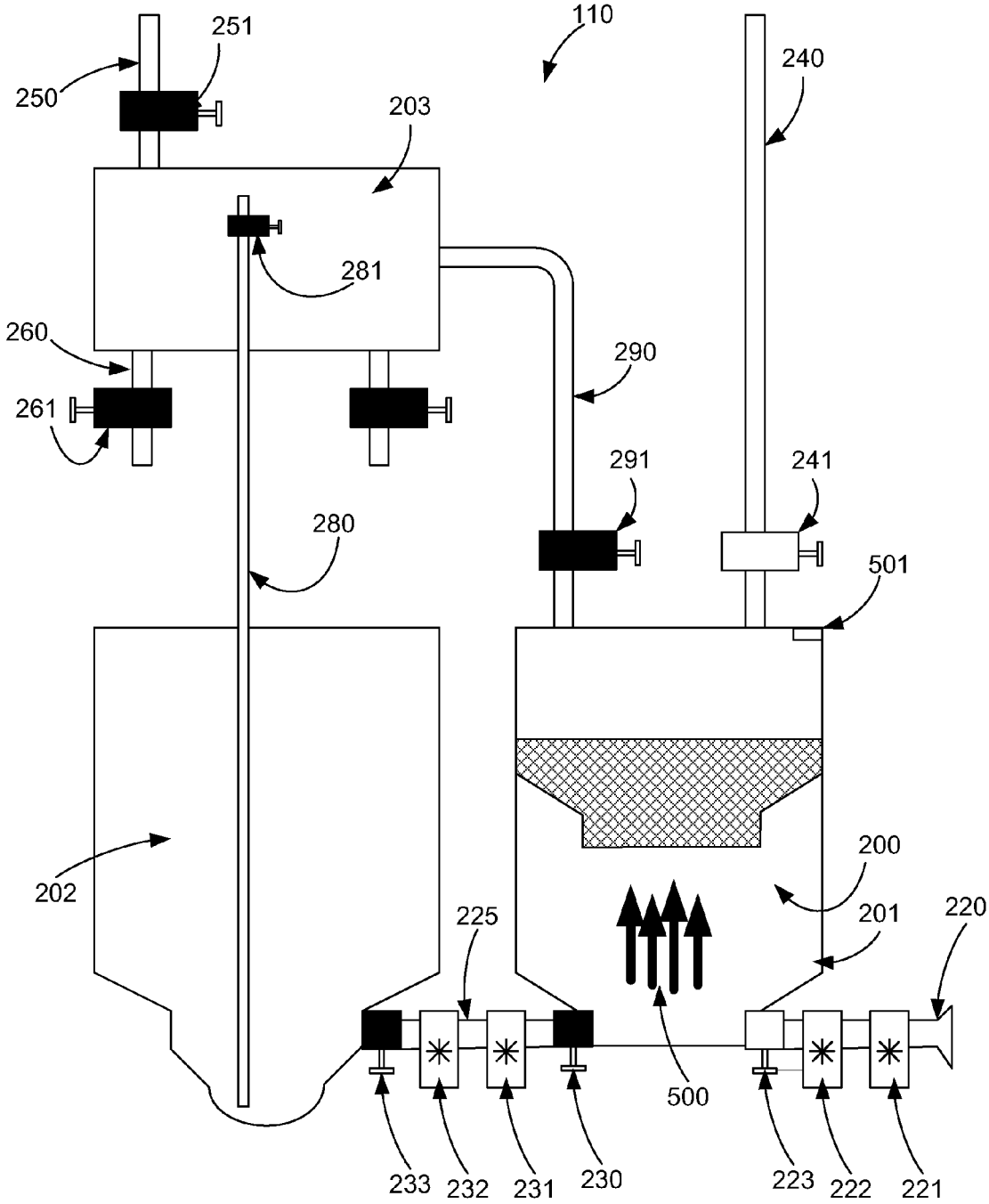
FIG. 5 shows a diagram of a hydro-hydraulic gravitational generator during a piston generation step of a method for generating electrical energy according to an embodiment of the subject matter disclosed herein.

FIG. 5 shows a diagram of a hydro-hydraulic gravitational generator during a piston energy generation step of a method for generating electrical energy according to an embodiment of the subject matter disclosed herein. With the water intake valve 223 open, deep water pressure exerts a force 500 on the base of the piston 201 and water begins to fill the main housing 200 below the piston 201. As water rushes through the water intake line 220, electrical power is generated through water turbines 221 and 222. Furthermore, air is forced out through the atmospheric pressure line 240 that may be harnessed via one or more air turbines 242 for generating additional electrical power.

As the piston 201 reaches the top of the main housing 200, the piston 201 triggers a switch 510 that causes the water intake valve 223 to close. This piston equilibrium state is shown in more detail with respect to FIG. 6.

Figure 6:
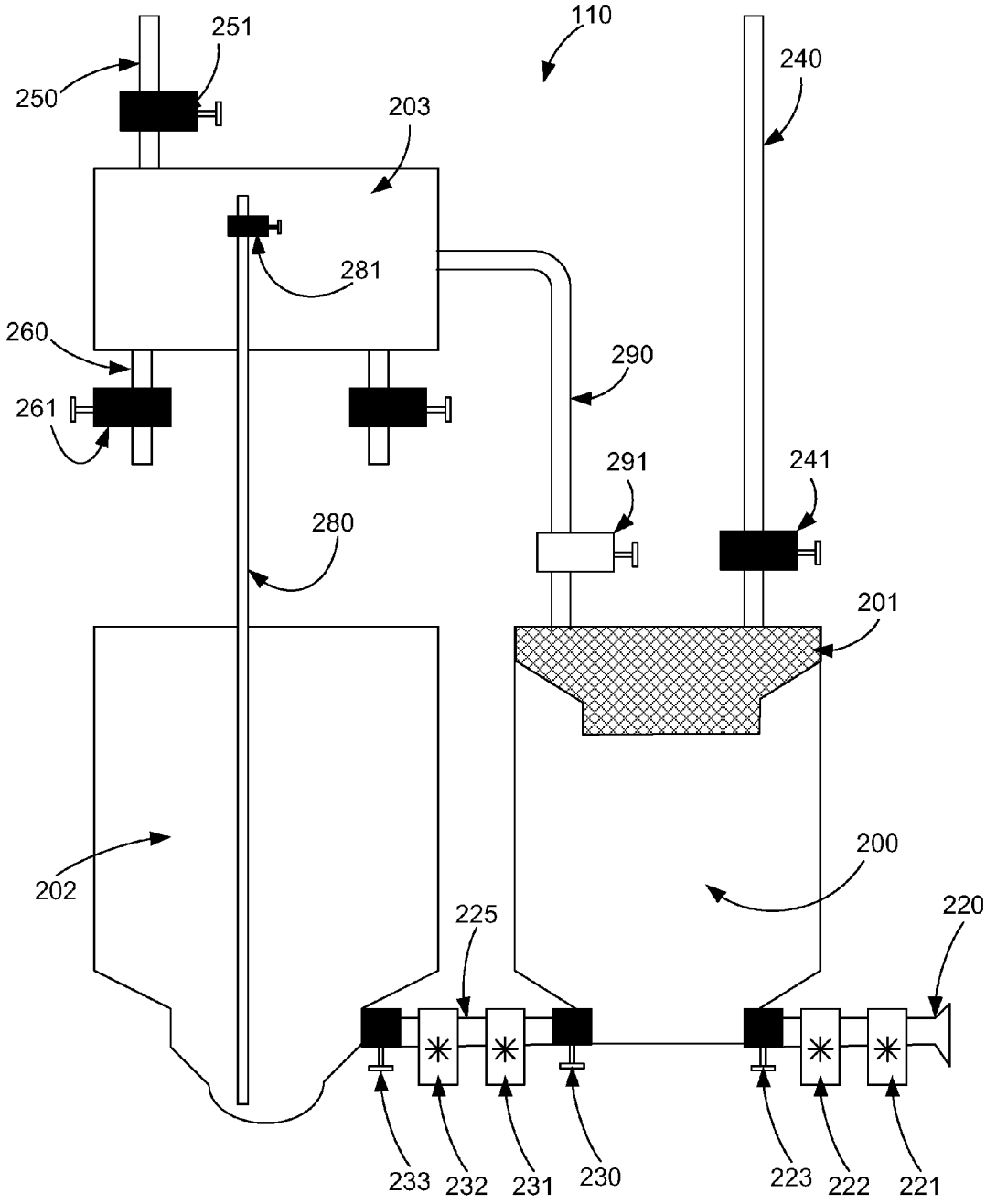
FIG. 6 shows a diagram of a hydro-hydraulic gravitational generator during an piston equilibrium step of a method for generating electrical energy according to an embodiment of the subject matter disclosed herein.

FIG. 6 shows a diagram of a hydro-hydraulic gravitational generator during a piston equilibrium step of a method for generating electrical energy according to an embodiment of the subject matter disclosed herein. The main housing and its contents (i.e., the water below the piston 201) are at equilibrium. That is, the deep water pressure forcing the piston 201 up is equal to the sum of the weight of the piston 201 and a force exerted downward from the piston 201 contacting the top of the main housing 200. The piston 201 is held in this position as the water intake valve 223 and the atmospheric pressure line valve 241 transition to a closed position. In this momentary equilibrium state, water neither enters nor leaves the main housing 200. As the switch 501 is triggered to close the water intake valve 223 and the atmospheric pressure valve 241, other valves are also triggered to transition to an open state. In particular, the water exit line valve 230 and the water collection housing intake valve 233 are opened to allow water stored in the main housing 200 to begin flowing to the water collection housing 202 through the water exit line 225. As water rushes through the water exit line 225, electrical power is again generated from water turbines 231 and 232. Additionally, the vacuum draw line control valve 291 is also opened such that air may be drawn into the main housing above the piston 201.

Figure 7:
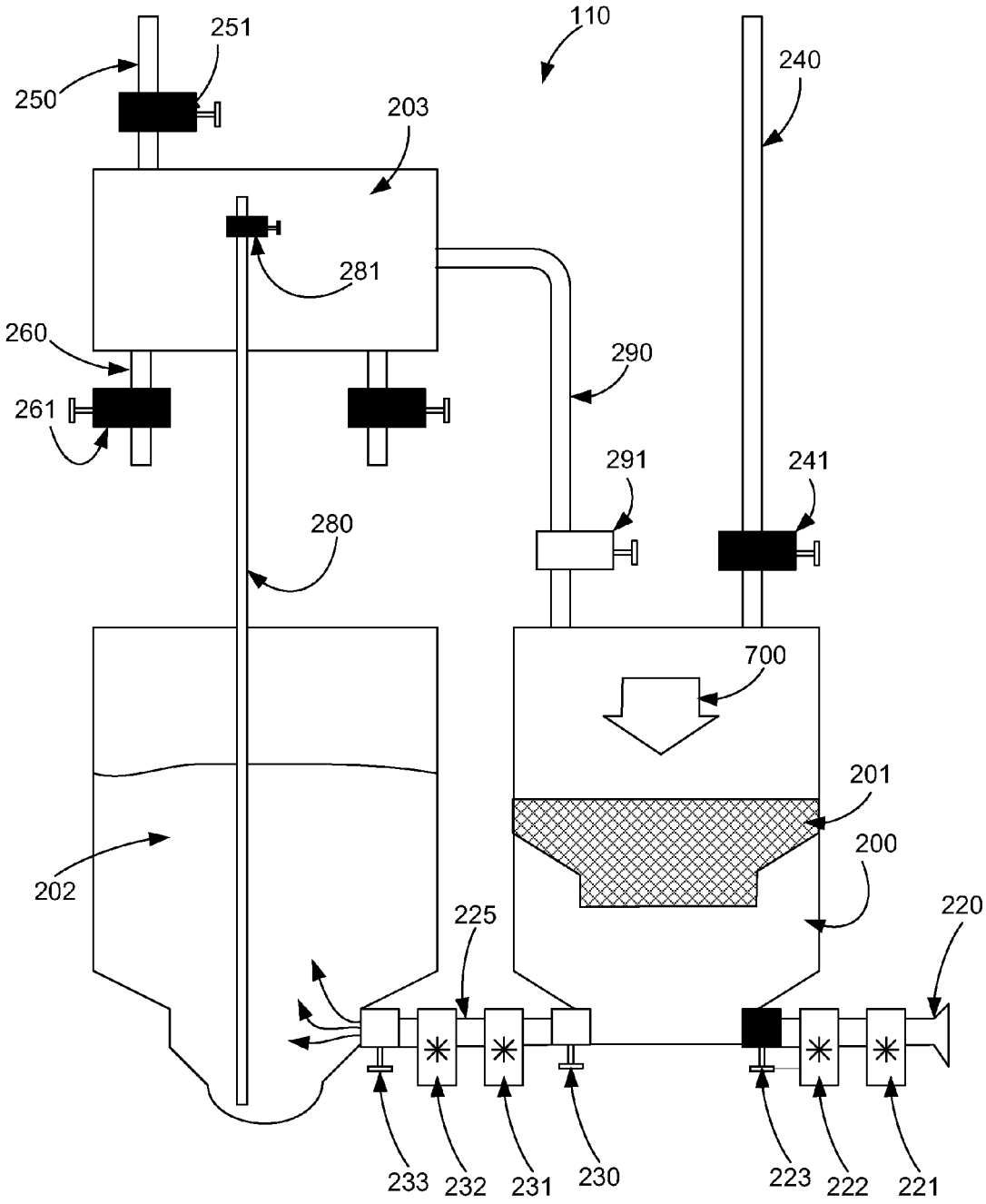
FIG. 7 shows a diagram of a hydro-hydraulic gravitational generator during an piston compression step of a method for generating electrical energy according to an embodiment of the subject matter disclosed herein.

FIG. 7 shows a diagram of a hydro-hydraulic gravitational generator during a piston compression step of a method for generating electrical energy according to an embodiment of the subject matter disclosed herein. With the configuration of open and closed valves as shown, a gravitational force on the 3-ton piston forces the water below out the main housing 200 though the water exit line 225 and into the water collection housing 202.

Furthermore, air that is in the water collection housing 202 may be drawn into the vacuum housing 203 because of the vacuum created as the piston 201 is lowered. As the piston 201 initially rises, air is expelled from the space above the piston 201 in the main housing 200. This air is expelled out the atmospheric pressure line 240 (with the atmospheric pressure line valve 241 open running air turbines (not shown in FIG. 7 if desired). Air will not flow into the vacuum chamber 203 (as the vacuum housing valve 291 is closed). Once the piston 201 reaches its maximum height, the atmospheric pressure line valve 241 is closed. With both atmospheric pressure line valve 241 and vacuum chamber valve 291 closed, the piston 201 cannot move. When the vacuum chamber valve 291 opens, the piston 201 to be able to move downward under its own weight due to gravity.

As the piston 201 falls, the space above the piston 201 draws air from the vacuum chamber 203 to fill its increasing volume as the piston 201 drops. Air does not come from the atmospheric pressure line 240 as its valve 241 is closed. With the other valves (valves 251, 261, et al.) of the vacuum chamber 203 closed, air is drawn from the water collection housing 202, through the vacuum chamber 203 to the main housing 200.

Those skilled in the art will understand that a complete removal of air or the creation of a true vacuum is not possible as this would stop the piston 201 from falling and thus cease operation of the system 110. However, a negative air pressure may be created forming vacuum effects. Once this system 110 is closed, additional pumps 261, with minimum energy input, can be used to pump out remaining air from any chamber in the system 110. The additional pumps 261 help create a better vacuum in the main housing 200.

Figure 8:
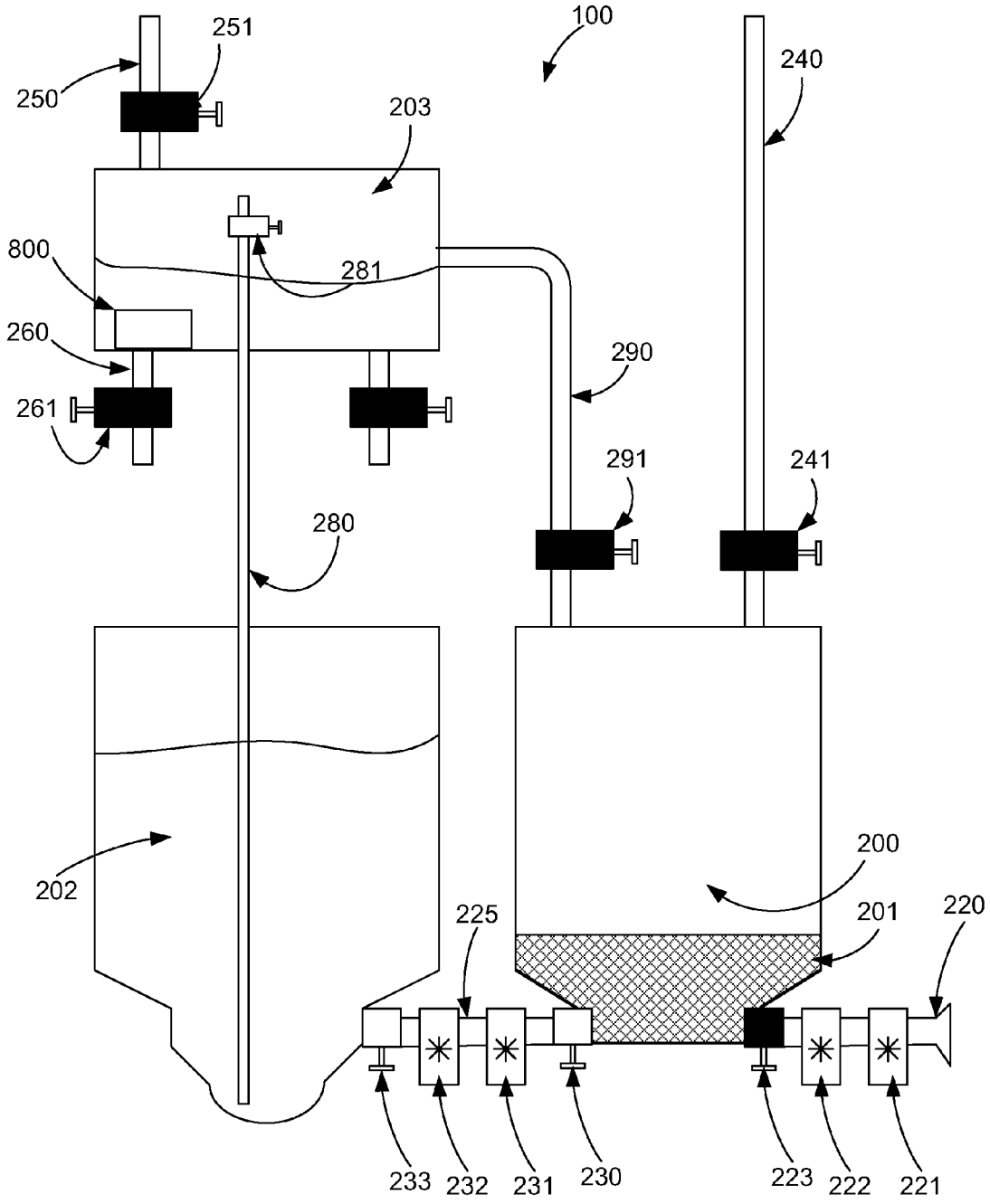
FIG. 8 shows a diagram of a hydro-hydraulic gravitational generator during an collection housing equilibrium step of a method for generating electrical energy according to an embodiment of the subject matter disclosed herein.

FIG. 8 shows a diagram of a hydro-hydraulic gravitational generator during a collection housing equilibrium step of a method for generating electrical energy according to an embodiment of the subject matter disclosed herein. As the piston 201 reaches the bottom of the main housing 200, the piston 201 once again triggers a number of valves to transition open/closed states. In particular, the vacuum draw line valve 291, the water exit line valve 230, and the water collection housing intake valve 233 are transitioned to a closed state. Further, the water intake valve 223 and the atmospheric pressure line valve 241 are transitioned to an open state such that the power generation cycle may repeat.

The water that is now in the water collection housing 202 is then drawn up through the water siphon line 280. This drawing of water from the water collection housing 202 to the vacuum housing 203 may be further aided by water pumps 800 and eventually out of the vacuum draw housing via water release lines 260 and associated water release valves 261.

Figure 9:
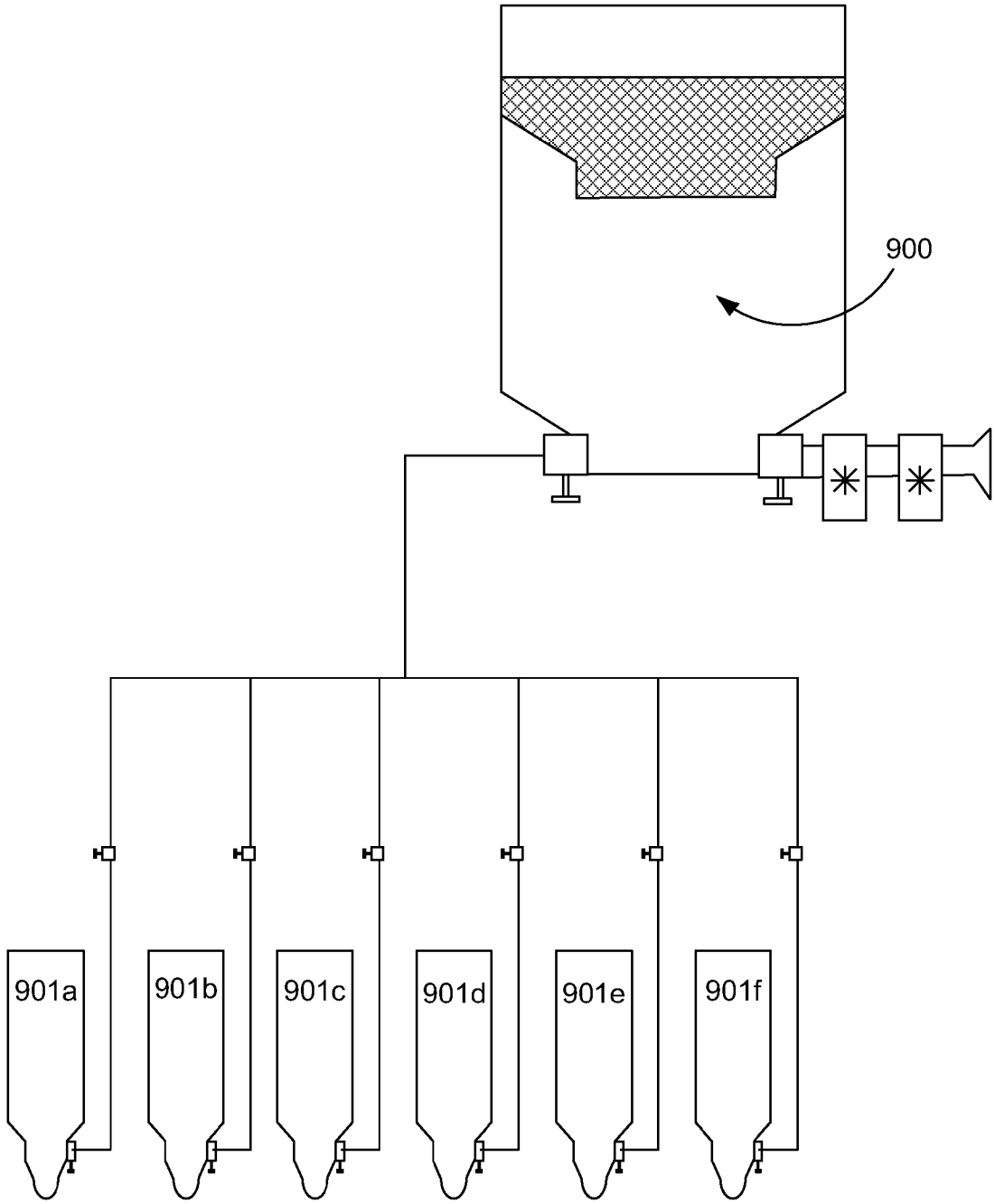
FIG. 9 shows a diagram of a hydro-hydraulic gravitational generator having multiple collection housings according to an embodiment of the subject matter disclosed herein.

FIG. 9 shows a diagram of a hydro-hydraulic gravitational generator having multiple collection housings according to an embodiment of the subject matter disclosed herein. In this embodiment, a single main housing 900 may be connected to a number of water collection housings 901*a-f*. After enough water is expelled into a first water collection housing 901*a*, a series of valves transition to direct expelled water into a second water collection housing 901*b* during a second cycle. As each water collection housings 901*a-f* is filled in succession, the next empty water collection housing is used for expelled water. While one of the water collection housings 901*a-f* is being used to collect expelled water, each of the others are pumped to remove collected water. As the cycle transitions back to the first water collection housing 901*a*, it will be empty and ready to receive expelled water again. water Another embodiment of the HHG generator 110 requires no piston at all and water pressure alone moves water from one chamber to the next. Water is flooded into the main housing 201 and then exits to successive water collection housing 202 chambers which have become voided by the pumping of the water out of each chamber.

Yet another embodiment of the HHG generator 110 may include a bellows type bag or encasement bag (not shown) that is disposed in the main housing 201 below the piston 200. When water flows into the main housing 201 chamber, it may actually flow into a bag in the main housing below the piston 200. As the bag or bellows is filled with water, the piston is raised in the same manner that is described above without the bag/bellows. Similarly, as the piston 200 falls, water is expelled from the bag/bellows out of the exit line. Thus, the bag/bellows assists with maintaining a discrete water chamber below the piston 200 separate and distinct from the air chamber above the piston 200.

While the subject matter discussed herein is susceptible to various modifications and alternative constructions, certain illustrated embodiments thereof are shown in the drawings and have been described above in detail. Furthermore, those skilled in the art will understand that various aspects described in less than all of the embodiments may, nevertheless, be present in any embodiment. It should be understood, however, that there is no intention to limit the subject matter to the specific forms disclosed, but on the contrary, the intention is to cover all modifications, alternative constructions, and equivalents falling within the spirit and scope of the subject matter.

What is claimed is:

1. A method for generating electrical power, the method comprising:

flooding a water tank submerged in deep water through an intake line having a first turbine disposed therein, the first turbine producing electricity as water passes through;

purging the water tank though an exit line coupled to a collection tank, the exit line having a second turbine disposed therein, the second turbine producing electricity as water passes through; and pumping water out of the collection tank.

2. The method of claim 1 wherein the pumping comprises using a vacuum induced by the purging of the water from the water tank.

3. The method of claim 1, further comprising purging air from the water tank through an atmospheric pressure line having a third turbine disposed therein, the third turbine producing electricity as air passes through.

4. The method of claim 1, further comprising:

raising a piston disposed within the water tank during the flooding, the raising of the piston resulting from water pressure; and lowering the piston during the purging, the lowering of the piston resulting from gravity.

5. The method of claim 1, further comprising siphoning water out of the collection tank into a vacuum tank and purging water from the vacuum tank through water pumps.

6. A cyclical method of producing energy from water pressure and gravity in a hydro-hydraulic gravitational generator, the method comprising:

a first cycle for generating electrical energy from the flow of water though a water turbine into a water housing, the water flow generated by water pressure from surrounding ambient deep water;

a second cycle for generating potential energy by raising a piston disposed inside the water housing, the piston raised with water that flows into the water housing;

a third cycle for generating electrical energy from the flow of water though a water turbine out of the water housing and into a collection housing, the water flow generated by a gravitational force lowering the piston inside the main housing;

a fourth cycle for restoring the generator to a stage for repeating cycles including purging the collection housing of water and purging the main housing of air pressure that exceeds ambient sea level air pressure; and repeating each cycle.

7. The method of claim 6, further comprising a fifth cycle for generating electrical energy from the flow of air out of the main housing and through an air turbine.

8. The method of claim 6, further comprising a sixth cycle for vacuuming water out of the collection housing and into a vacuum housing.

9. An electrical power generator, comprising:

a main water housing having a water intake line and a water exit line, the water intake line submerged in deep water and operable to direct a flow of water into the main water housing, the flow resulting from deep water pressure;

at least one first water turbine disposed in the water intake line and at least one second water turbine disposed in the water exit line, each water turbine operable to generate electricity from water flow; and at least one water collection housing coupled to the water exit line and operable to receive water expelled from the main water housing.

10. The electrical power generator of claim 9, further comprising a piston disposed in the main water housing and operable to expel water from the main water housing when a gravitational force lowers the piston.

11. The electrical power generator of claim 9, further comprising:

a water intake line valve operable to allow or prevent the flow of water through the water intake line; and a water exit line valve operable to allow or prevent the flow of water through the water exit line.

12. The electrical power generator of claim 9, further comprising:

an atmospheric pressure line coupled to the main water housing operable to provide sea level air pressure inside the main water housing; and an atmospheric pressure line valve operable to allow or prevent the flow of air through the atmospheric pressure line.

13. The electrical power generator of claim 12, further comprising at least one air turbine disposed in the atmospheric pressure line and operable to generate electricity from the flow of air.

14. The electrical power generator of claim 9, further comprising a vacuum housing coupled to the main water housing via a vacuum draw line and could to the water collection housing via a water siphon line, the vacuum housing operable to siphon water from the water collection housing.

15. The electrical power generator of claim 14, further comprising:

at least one water pump operable to pump water out of the vacuum housing; and at least one vacuum housing atmospheric pressure valve operable to relieve air pressure inside the vacuum housing.

16. The electrical power generator of claim 9, further comprising at least one additional water collection housing coupled to the water exit line and operable to receive water expelled from the main water housing.

17. The electrical power generator of claim 9, further comprising at least one additional water collection housing coupled to a second water exit line and operable to receive water expelled from the main water housing, the second water exit line further comprising at least one water turbine operable to produce electricity.

18. A system for generating electricity, the system comprising:

a plurality water intake lines, each having a water intake valve, the plurality of water intake lines submerged in deep water;

a plurality of water intake turbines disposed in the plurality of water intake lines, each water turbine operable to generate electrical power when water flows though;

a main water housing coupled to each of the plurality of water intake lines, the main water housing having a piston movably disposed therein, the piston operable to raise and lower, the piston raising when water pressure from below exceeds its weight and lowering when the water pressure from below is lower than its weight;

a water collection housing coupled to the main water housing for receiving water that exits the main water housing;

a transmission line electrically coupled to each of the plurality of plurality of water turbines; and an electrical grid distribution connection coupled to the transmission line and operable to facilitate the generation of electricity to an electrical grid.

19. The system of claim 18, further comprising a second plurality of water turbines disposed in a water exit line coupled between the main water housing and the water collection housing, each of the second plurality of water turbines electrically coupled to the transmission line.

20. The system of claim 18, further comprising a plurality of air turbines disposed in an air pressure line coupled between the main water housing and ambient surface pressure, each of the plurality of air turbines electrically coupled to the transmission line.

* * * * *

UNITED STATES PATENT AND TRADEMARK OFFICE

CERTIFICATE OF CORRECTION

PATENT NO. : 7,911,073 B2
APPLICATION NO. : 12/247901
DATED : March 22, 2011
INVENTOR(S) : Todd Smith It is certified that error appears in the above-identified patent and that said Letters Patent is hereby corrected as shown below:

- In Claim 14, Column 8, Line 61, "draw line and could to the water" should read --draw line and coupled to the water--

- In Claim 18, Column 9, Line 16, "a plurality water intake lines" should read --a plurality of water intake lines--

- In Claim 18, Column 9, Line 21, "power when water flows though" should read --power when water flows through--

- In Claim 18, Column 10, Lines 7 and 8, "electrically coupled to each of the plurality of plurality of water turbines" should read --electrically coupled to each of the plurality of water turbines--

Signed and Sealed this
Third Day of July, 2012

David J. Kappos

David J. Kappos
*Director of the United States Patent and Trademark Office*